United States Patent [19]

Choderker et al.

[11] Patent Number: 4,741,427

[45] Date of Patent: May 3, 1988

[54] COIN ACCEPTOR WITH FINAL SIZE GAUGE SYSTEM

[76] Inventors: Nathan Choderker, 1880 S. Ocean Dr., Hallandale, Fla. 33009; Carl E. Dorman, 7155 W. 14th Ct., Hialeah, Fla. 33014

[21] Appl. No.: 785,993

[22] Filed: Oct. 10, 1985

[51] Int. Cl.[4] ..... G07D 5/02; G07D 5/04; G07F 3/02

[52] U.S. Cl. ..... 194/335; 194/336; 194/338; 194/341; 194/345; 209/625; 209/626

[58] Field of Search ..... 194/320, 321, 322, 323, 194/334, 335, 336, 338, 339, 341, 345, 346, 340, 344; 133/3 E, 3 R; 209/625, 626; 453/3

[56] References Cited

U.S. PATENT DOCUMENTS

| | | | |
|---|---|---|---|
| 1,193,967 | 8/1916 | Antoine et al. | 194/335 X |
| 1,313,032 | 8/1919 | Webster | 194/335 X |
| 1,704,930 | 3/1929 | Wagner | 194/339 |
| 2,588,510 | 3/1952 | Foushee et al. | 194/321 |
| 2,975,880 | 3/1961 | Gabrielsen | 194/321 |
| 3,059,748 | 10/1962 | Krysiak | 194/334 X |
| 3,506,104 | 4/1970 | Kaiser et al. | 194/335 |
| 3,897,864 | 8/1975 | Sciacero et al. | 194/335 X |

*Primary Examiner*—Joseph J. Rolla
*Assistant Examiner*—Edward S. Ammeen
*Attorney, Agent, or Firm*—Jack E. Dominik

[57] ABSTRACT

A coin acceptor which receives coins in a slanted coin chute with a final size gauge system. The coin is first rebounded against a tapered wall and enters a first zone. All three coin sizes enter the first zone and then the lightest weight one passes down a tapered ramp which is spring loaded, but the lightest weight coins will not depress the ramp and therefore such coins are diverted into a second zone. The heavier different sized coins pass down and trip the tapered ramps, both a first and second one, and then the widest of the coins continues downwardly in the first zone to be processed and sized for diameter. The largest diameter coin is trapped between two pins where it is then tilted off of a ramp onto a diverter and passes into a third zone for processing. As all of the coins reach the bottom of their three separate zones, they enter into a final size gauge system which has three coin chutes sized precisely to reject any coin which is bent, burred, or oversized. Magnets coact with each chute for trapping any coin of ferrous content and preventing it from going into the accept slot. A reject release is provided which, when activated, opens up all of the chutes in the final size gauge after tilting or rotating the final size gauge so that it will drop the released coin down the reject chute rather than permit the same to pass down the accept chute.

13 Claims, 7 Drawing Sheets

COIN ACCEPTOR WITH FINAL SIZE GAUGE SYSTEM

FIELD OF THE INVENTION

The subject invention relates to a coin acceptor, and more particularly one which will gauge small lightweight coins such as a United States ten cent piece, middleweight thick coins such as a United States five cent piece, and thin large diameter coins such as a United States twenty-five cent piece. The coins are so segregated that they will drop into a coin acceptor on a vending machine in ascending order of value, namely, five cents, ten cents, and twenty-five cents.

SUMMARY OF THE PRIOR ART

Coin acceptors have been known for years and are intended to gauge coins for size, weight, and ferrous content. Many electronic coin acceptors are available, but like most electronic devices, they are complex to repair and replace and costly to manufacture. Of the mechanical devices, they are subject to frequent blockage and resultant downtime on a vending machine.

Of particular importance is the quality and capability of a coin acceptor on a vending machine having an accumulator. The purpose of an accumulator is to accumulate and count various coins where combinations of coins are required to make the purchase. For example, if the purchase is sixty-five cents, the machine could receive five ten cent pieces and three five cent pieces. Alternatively, it could receive two twenty-five cent pieces, one ten cent piece, and one five cent piece. Such accumulators are very sensitive to the proper size of coins. Thus when a coin is damaged or has a burr, or even a hole in it which modifies its diameter, the currency may be good legal tender, but it can cause a jam in the accumulator.

Accordingly the industry, particularly with vending machines such as cigarette vending machines, requires a coin acceptor which whenever in doubt as to the proper size of a coin, will cause the same to be rejected even though the coin may be good legal tender. The user of the machine will sense that his coin is being repeatedly rejected, and therefore use another coin rather than the acceptor directing a bad coin to the accumulator which will cause a problem and likely shut down.

SUMMARY OF THE INVENTION

The present invention is directed to a coin acceptor which receives coins in a traditional coin chute. The coin is first rebounded gainst a tapered wall and enters a first zone. All three coin sizes enter the first zone and then the lightest weight one passes down a tapered ramp which is spring loaded, but the lightest weight coins will not depress the ramp and therefore such coins are diverted into a second zone. The heavier different sized coins pass down and trip the tapered ramps, both a first and second one, and then the widest of the coins continues downwardly in the first zone to bprocessed and sized for diameter. The largest diameter coin is trapped between two pins where it is then reversed and thereafter tilted off of a ramp onto a diverter and passes into a third zone for processing. As all of the coins reach the bottom of their three separate zones, they enter into a final size gauge system which has three coin chutes sized precisely to reject any coin which is bent, burred, or oversized. Magnets coact with each chute for retarding any ferrous content coin passing into the chute from going into the accept slot. A reject release is provided which, when activated, opens up all of the chutes in the final size guage after tilting or rotating the final size guage so that it will drop the released coin down the reject chute rather than permit the same to pass down the accept chute.

In view of the foregoing it is a principal object of the present invention to provide a mechanically actuated coin acceptor which will size accurately for validity of the currency a heavy medium size coin, a thin small size coin, and a middleweight large diameter coin prior to the same being directed into an accumulator or other counting device.

Another object of the present invention is to provide a coin acceptor with the above characteristics which is readily formed of moldable plastic parts and inexpensive to manufacture.

Yet a further object of the present invention is to provide a coin acceptor with the aforementioned features which can be easily serviced and repaired or replaced.

BRIEF DESCRIPTION OF THE DRAWINGS

Further objects and advantages of the present invention will become apparent as the followiong description of an illustrative embodiment proceeds taken in conjunction with the accompanying drawings, in which:

FIGS. 16, 17 and 18 show respectively the first zone coin, second zone coin, and third zone coin;

DETAILED DESCRIPTION OF A PREFERRED EMBODIMENT

Figure 1:
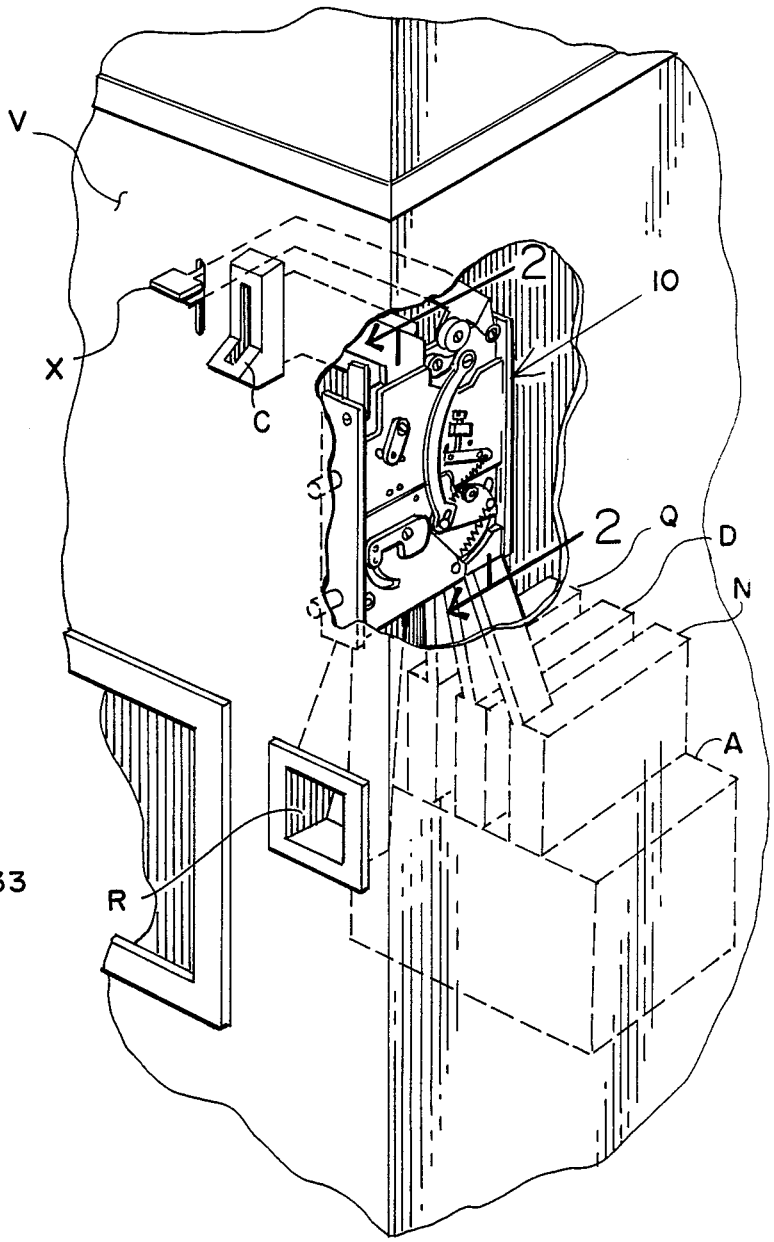
FIG. 1 is a perspective partially diagrammatic view of a vending machine showing the location of the coin acceptor and accumulator.

The present invention is directed to a coin acceptor 10 which finds its principal utility, as shown in FIG. 1, interiorly of a vending machine V which is intended to accept coins or reject them and deliver the accepted coin to an accumulator A. The coins are inserted through a common coin slot C from which good coins are processed to be delivered from the coin acceptor 10 into three slots in ascending order of currency, shown here as N, D and Q for nickel, dime and quarter which are United States currency of 5 cents, 10 cents, and 25 cents rspectively. The industry supplies accumulators A which receive the coins in this sequence. For different currencies, the chutes can be varied and cross over where the ascending nature of the currency does not correspond to the United States sizes or weights, nor do the accumulators. The coins are dropped into a common coin slot C, as mentioned, but should they not pass through to the accumulator, the reject release arm X is actuated by the user of the vending machine V, and the non-accepted coin is returned through the reject chute R. Here it should be emphasized that the subject coin acceptor 10 is not intended to pass all coins of good legal tender, unless they are sized and in a condition that they will be readily processed in the accumulator without causing a jam. Accordingly, many coins which are physically damaged, out of size, or otherwise not acceptable to the accumulator A will be returned through the rejection chute R.

Figure 2:
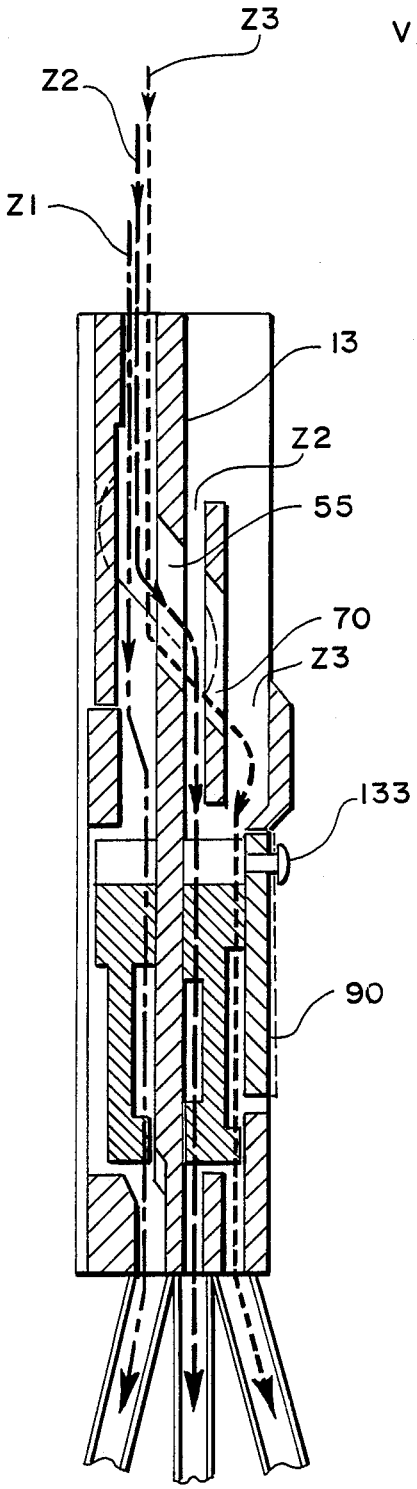
FIG. 2 is a transverse sectional view of the coin acceptor of FIG. 1 taken somewhat diagrammatically to illustrate the three zones for processing the three separate coins and identifying the same by phantom lines which are different as between all three zones.

The basic theory of operation will be best understood by first noting FIG. 2 wherein the coin acceptor 10 is shown as being built around a main plate 13 which, with other elements, defines a first zone Z1, a second zone Z2, and a third zone Z3. All of the coins passing through enter into the first zone Z1. One of the coins proceeds down the zone Z1 for processing for size, weight, and denomination all the way to the bottom chute, and this coin is designated by a code with a dotted center line configuration. The second coin enters into the first zone Z1, but then passes through a second zone diverter 55 into the second zone and is processed similarly until it goes into the final size gauge assembly 90 at the bottom. This is shown by heavy dashed lines. The third coin enters into the first zone Z1, and is then passed through the third zone diverter 70 and proceeds into the third zone Z3 into the acceptor assembly 90. By the time all three coins get to the final size gauge 90, they have been generally sized for their own currency, they have been weighed, but they have not been tested for ferrous content which would reject any coin as legal tender, nor have they been checked for damage in the form of burrs, holes, projections, bending, and the like. This all occurs in the final size gauge 90. Magnets are provided in the final size gauge 90 which coact with all three of the zone chutes and stop a coin from passing into the coin accumulator A. As to any such coin stopped by the magnet, the final size gauge 90 is rotated rearwardly to direct the coin towards the rejection chute R when the reject release arm X is actuated, and the plate members of the final size gauge 90 expanded from each other to permit the coin to fall out irrespective of whether it was blocked by a damaged or out-of-size configuration, or blocked by a magnet. As stated in the Summary above and the objects, the purpose of the coin acceptor 10 is to reject any coin from passing into the accumulator A which could cause a jamming of the accumulator, even through the coin is good legal tender. Thus the activity of the final size gauge 90 is important to achieving the objectives and the purpose of the present invention.

Figure 3:
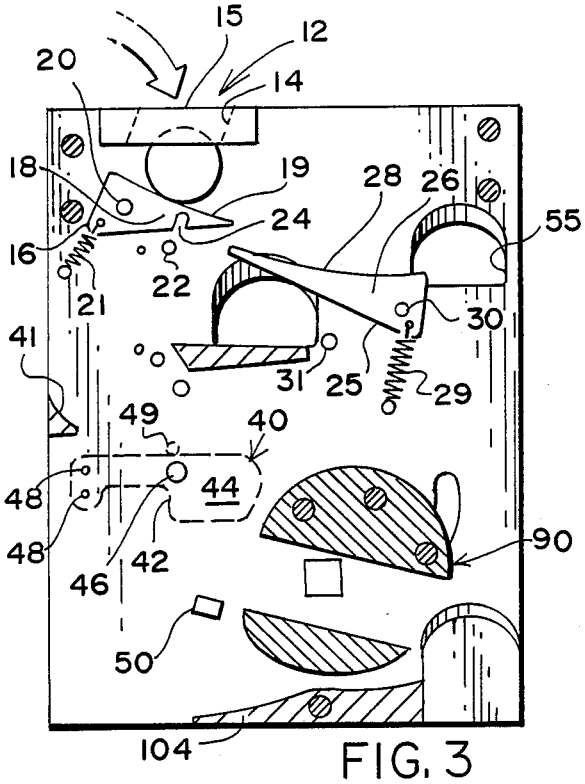
FIGS. 3–6 inclusive are diagrammatic taken through the central portion of the first zone to illustrate the processing of a middle sized coin, in this instance a United States five cent piece also known as a nickel.
Figure 4:
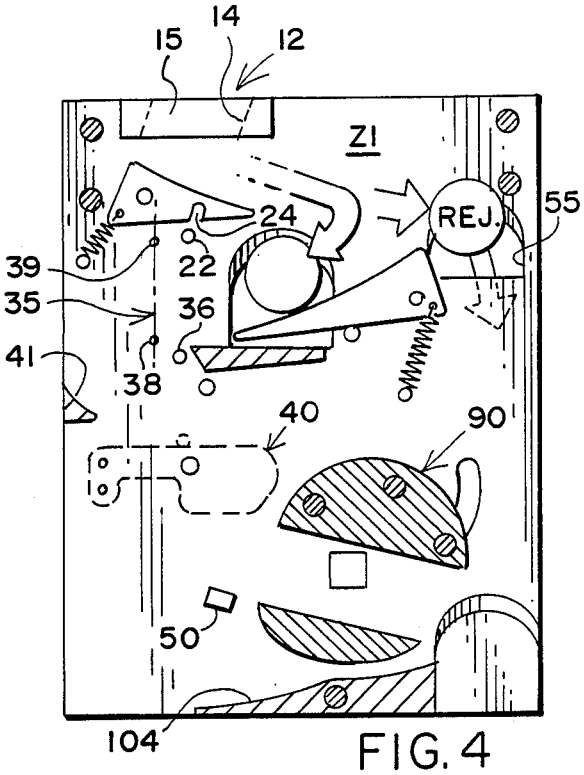
Figure 5:
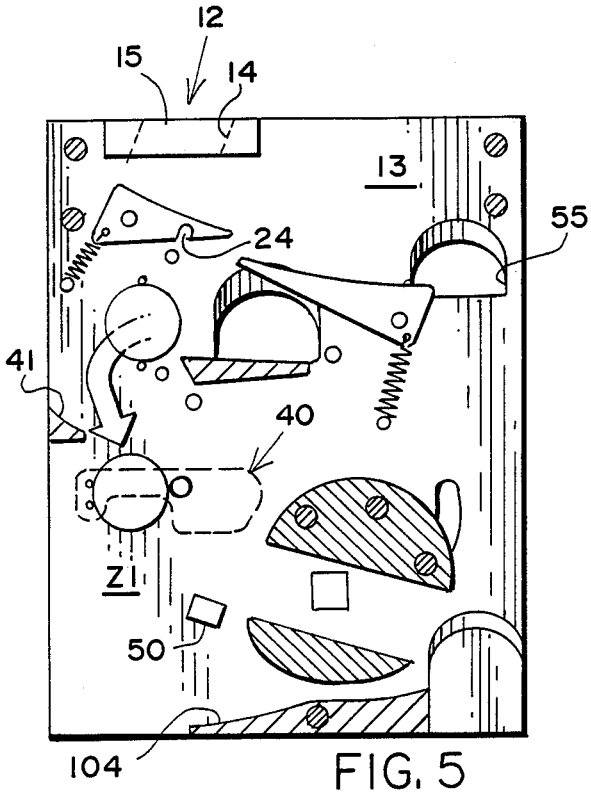
Figure 6:
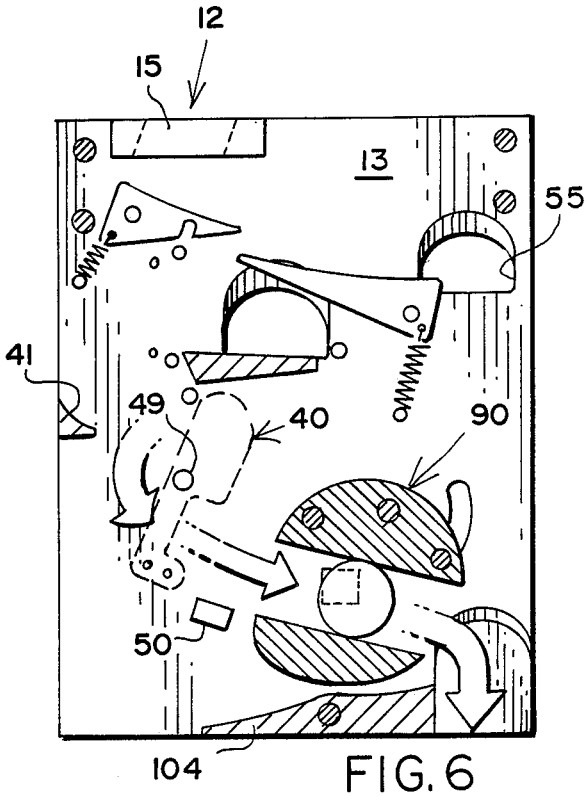
Figure 7:
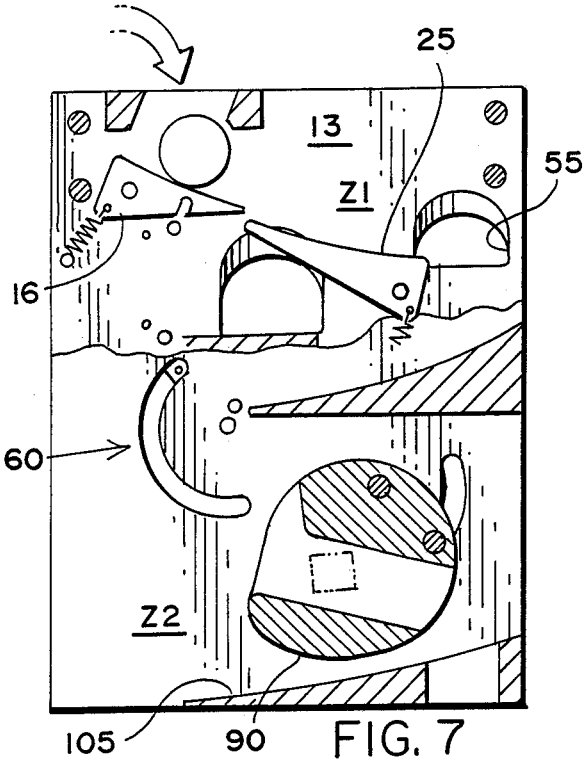
FIGS. 7–10 inclusive illustrate at the upper portion the first zone which is common to the processing of all coins, and then at the lower portion the processing of the lightweight small diameter coin or United States ten cent piece in the second zone which is behind the main plate.

Referring now to FIG. 3, the passage of the middleweight and thickness coins will be traced through the coin acceptor 10. At the beginning the coin rebounds off of a tapered wall 14, and then passes into a central slot 15. This rebounding off the tapered wall 14 causes all three of the coins to be confined to a particular path, and also decelerates the same to a common speed as they pass through the first zone Z1. The coin drops onto the first differentiator assembly 16 which includes a pivot ramp 18 having ramp surface 19. The pivot ramp 18 is secured at pivot mount 20 and is pivoted by means of a tension spring 21 and its travel is limited by the travel stop 22. With a lightweight coin it passes directly through to the second zone diverter 55. With a coin such as shown here, turning now to FIG. 4, it will be seen that it has lowered the pivot ramp 18 and proceeded to the second differentiator 25 and on the concave ramp surface 28 after the pivot arm has been deflected as shown in FIG. 2 and stopped by the spring loaded retarding pin 31, which acts against the retard return spring 29. Also to be noted is that the ramp surface 28 is somewhat concave in nature. At this point the coin passes to the diameter gauge station 35 and engages the retard pin 36. Both the lower gauge fixed pin 38 and the upper gauge adjustable pin 39 coact to pass coins of the appropriate diameter. As will be seen later, a larger diameter coin will be rejected and diverted rearwardly, whereas the coin intended for the first zone Z1 as shown here continues downwardly to the undersize differentiator assembly 40 after passing off of the centering deflector 41. Thus all coins are processed and passed in the first stage of the first zone for further processing and acceptance or rejection. This precludes jamming in the first stage of the first zone. The coin then engages the pivotal cradle body 42 of the undersize differentiator assembly which body has a counterweight 44, a pivot arm 45, and the same being pivoted about pivot point 46. To be noted in particular are the two arm pins 48 to receive the coin and rotate the cradle body 42, and to coact with the offset fixed pin 49 to open up the slot and permit a good coin to drop onto the skip block 50 from which it passes into the final size gauge assembly 90 for further processing. Thus the coin is totally sized for diameter, and weight, prior to entering into the final size gauge 90. The entirety of this processing has taken place in the first zone Z1 which is forward of the main plate 13 of the coin acceptor 10.

Figure 8:
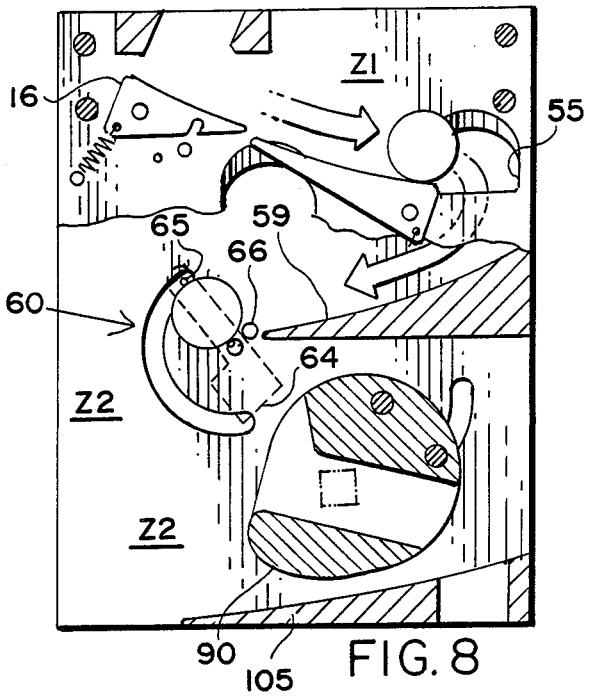
Figure 9:
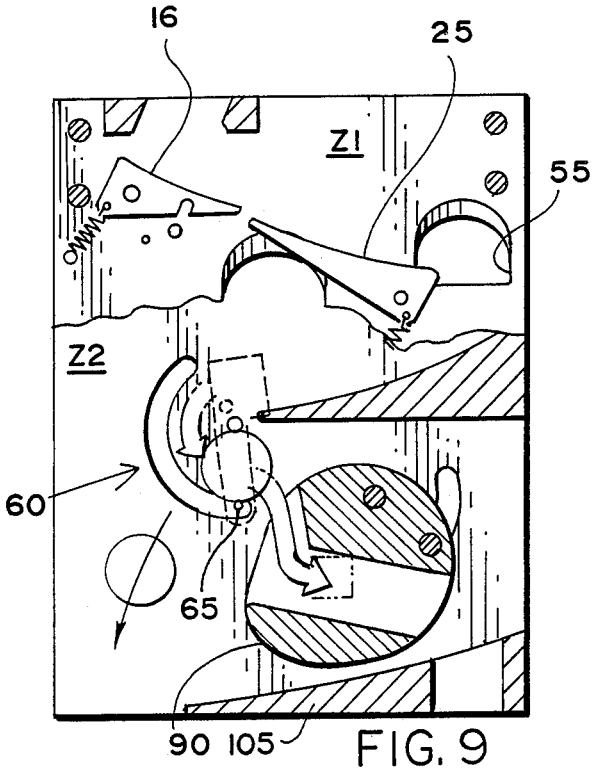
Figure 10:
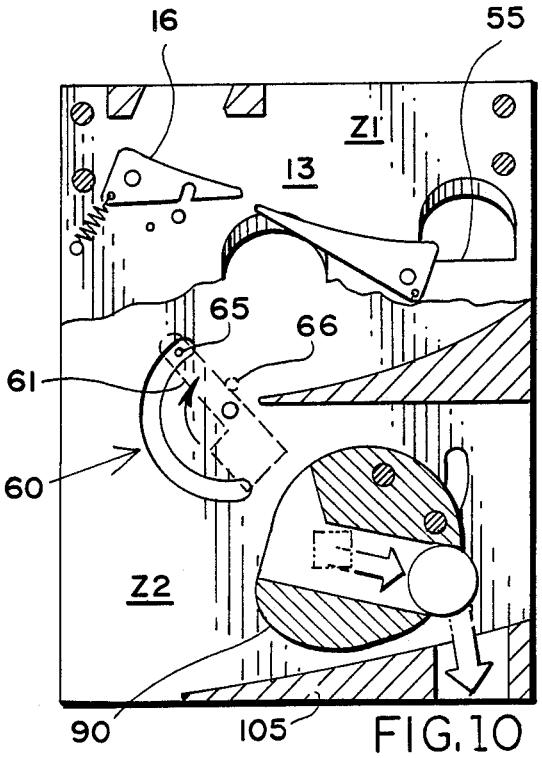
Figure 11:
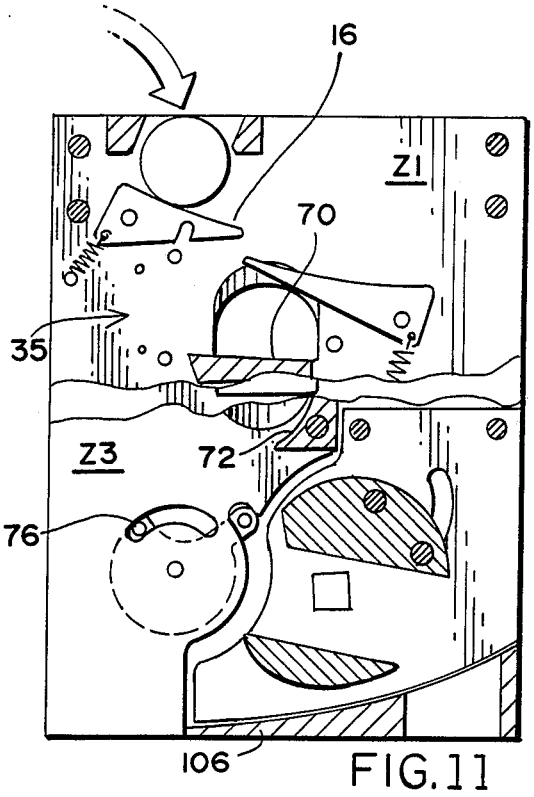
FIGS. 11–14 inclusive, at the upper portion, show the large diameter heavier coin or United States twenty-five cent piece entering the first zone and then being diverted (particularly as shown in FIG. 13) into the third zone for final processing.

The processing of the small size lightweight coin through the first zone Z1 and the second zone Z2 is disclosed in FIGS. 7–10 inclusive. There it will be seen that the coin enters the central slot 15 after rebounding off the tapered wall 14 and descends to the first differentiator 16. The coin passes directly down the ramp surface 19 since it is not heavy enough to depress the first differentiator 16. It then proceeds to the second differentiator 25 and passes down the second differentiator concave ramp surface 28 and, because it is still lightweight, it does not depress the second differentiator and therefore passes through the second zone diverter 55 and main plate 13 for further processing in the second zone Z2 as shown diagrammatically in FIG. 8. Upon entering the second zone Z2 as shown in FIG. 8, the coin passes down the second zone fixed ramp 56 along the fixed ramp track curve 59. The coin after passing down the curve track 59 is prepared to enter the differentiator for lightweight and small diameter coins 60. As will be seen, the differentiator 60 includes a body 61 having an arm 62 and a counterweight 64. A moving gauge pin 65 is provided on the end of the arm 62, and the coin coacts with the moving gauge pin 65 as well as the offset fixed gauge pin 66 which, as the coin pivots about its pivot point effectively opens the gap and permits the coin, if the proper size, to be thrown into the final size gauge 90 as shown in the sequence between FIGS. 9 and 10. If the coin is too light of weight, it will divert as shown by the arrow in the lower left-hand portion of FIG. 9. Also if it is out of size or magnetic, it will be caught in the final size gauge 90 as will be described hereinafter. Thus a good coin will pass, as shown in FIG. 10, into the second zone Z2 chute and on to the accumulator A.

Figure 12:
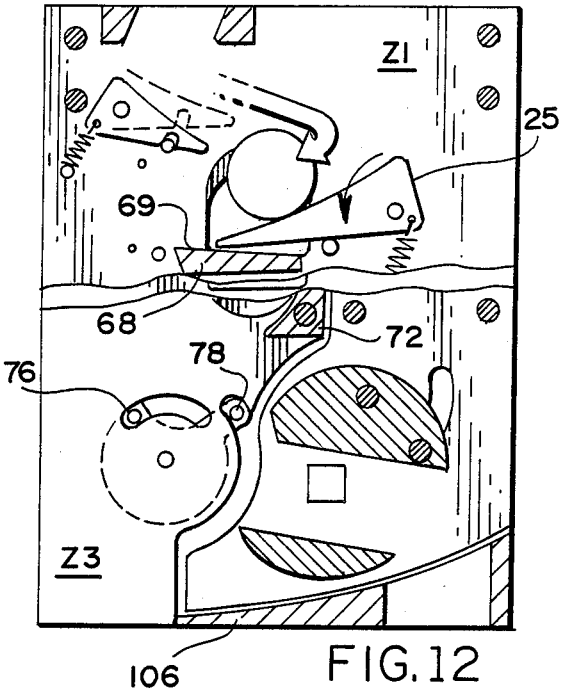
Figure 13:
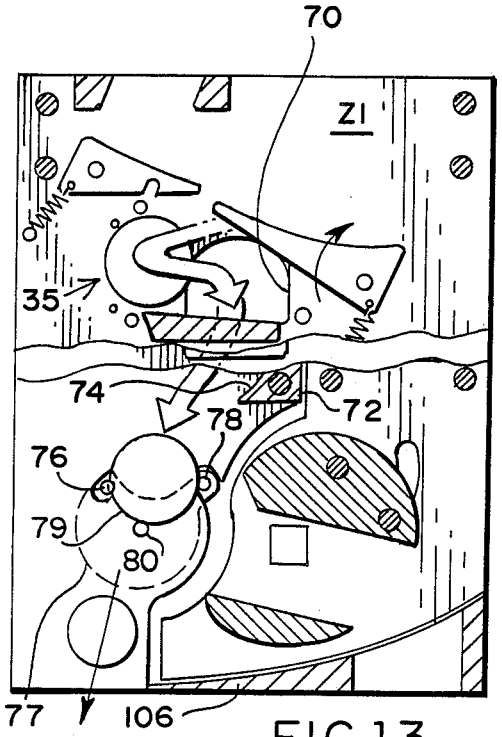
Figure 14:
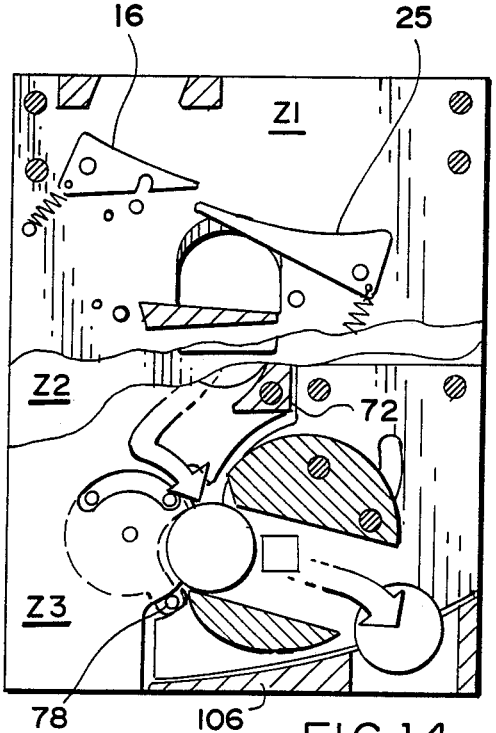

For the processing of a large diameter heavier coin from the first zone Z1 to the third zone Z3 see the diagrammatic showing in FIGS. 11–14 inclusive. Beginning in FIG. 11, it will be seen that the larger coin rebounds from the angled wall 14 and enters the slot 15. It thereupon engages the first differentiator 16 and depresses the same just as shown with the first coin in FIGS. 3 and 4. It then proceeds to the second differentiator 25 and depresses it and proceeds forwardly still in zone 1, essentially as shown in FIG. 12. At this point the coin arrives on the diverter ramp, and scoots on top of the diverter track 69 until it hits the diameter gauge station 35. While the diameter gauge station 35 passed the first coin through zone 1, as shown in FIGS. 3–6 inclusive, the spacing in such that it causes the larger coin to reverse its direction, particularly as shown in FIG. 13, and then passed through the third zone diverter 70 and on into the third zone for further processing. Once the larger diameter coin is in the third zone, it engages the shift block 72 as shown in FIG. 13 in the third zone area. This causes the coin to be directed to the shift block track 74 and its direction reversed to the thickness differentiator 75. The thickness differentiator 75 includes a V-pin 76, a round body 77, and a fixed pin 78 on the offset arm 79. As will be seen the pivot mount 80 causes the thickness differentiator 75 to rotate, as it is cradled between the V-pin 76 and the fixed pin 78. If the coin is undersize, or thinner it will drop between those two pins and be rejected. If it is the correct size, it drops down to the final size gauge assembly 90 as shown in FIG. 14 and passes to the accumulator A if the size, thickness, and condition are appropriate and there is no ferrous content.

Figure 15:
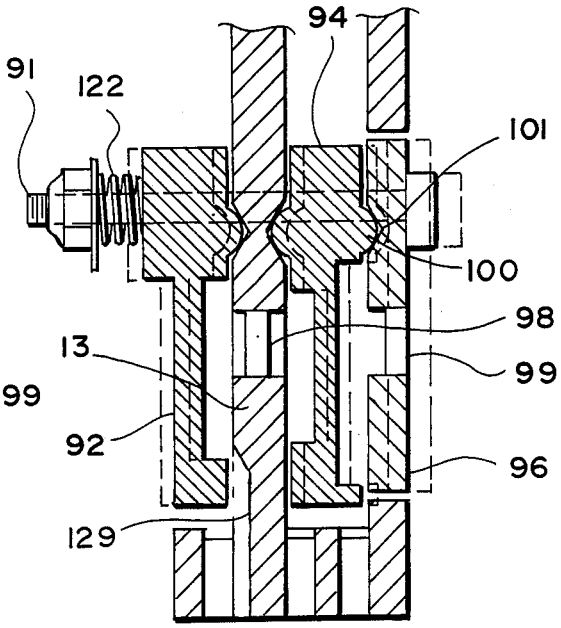
FIG. 15 is an enlarged partially diagrammatic transverse sectional view of the final size gauge wherein coins are received from zones 1, 2 and 3 into gauging slots and, if not attracted by the magnets, or not stopped by the slots due to sizing problems, discharge into the accumulator.

As set forth above, as the various three coins pass through the first zone Z1, second zone Z2, and third zone Z3, they are checked for diameter, and weight. They are not checked for ferrous content, nor are they checked for thickness or mutilation. That is all done in the final size gauge assembly 90. Turning now to FIG. 15, it will be seen that the final size gauge assembly 90 is pivotally mounted for rotation around a spring loaded axle shaft 91. A first zone track plate 92 is mounted on the shaft 91, as well as a second zone and third zone track is provided by its assembly 94. In each instance the tracks or chutes are denominated Z1, Z2, and Z3. At the right side, a second and third zone expansion plate 96 is spring loaded on the "sandwich" which makes up the final size gauge 90. Each of the chutes is flanked by magnets 98 and 99 which will retard any ferrous content coin passing in the respective chutes.

Figure 16:
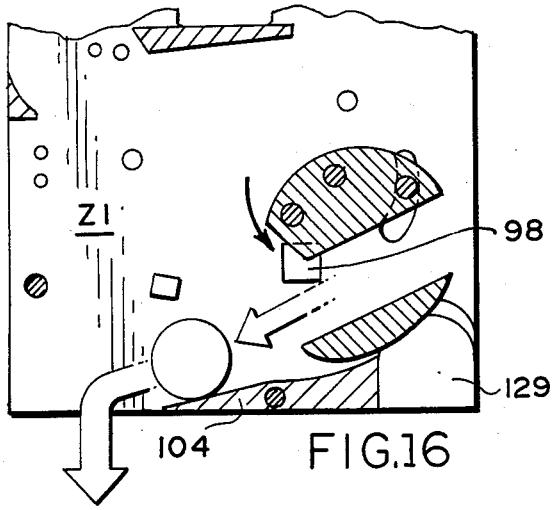
FIGS. 16–18 inclusive show coins which have entered the final size gauge from the first zone, second zone, and third zone which are being rejected because they would not pass through the three zone chutes such as shown in FIG. 15.
Figure 17:
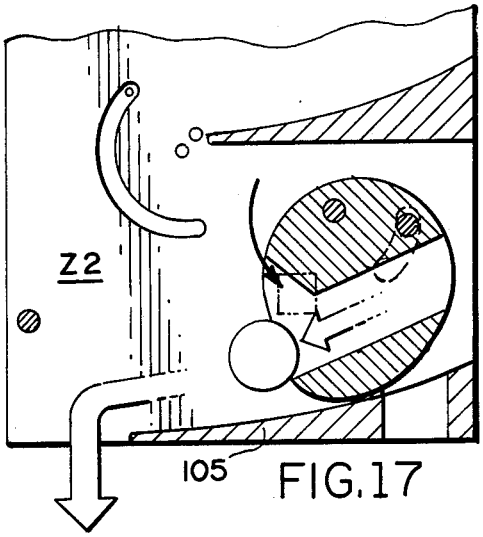
Figure 18:
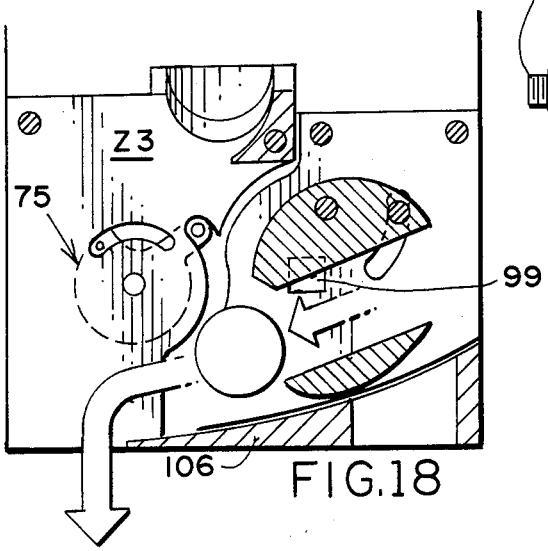

An expansion actuator 100 includes a plurality of dimples 101 and mating curved tracks 102 which, when the reject release arm X is actuated, rotate from the downward configuration of delivering the coin as seen from FIGS. 3–14 inclusive, to the reject configuration as shown in FIGS. 16, 17 and 18. The motion is essentially the same for all three chutes and all three coins which are trapped by the final size gauge 90 due to improper thickness, mutilation, or ferrous content. As shown in FIG. 16 there is the first zone reject ramp 104, a second zone reject ramp 105, and a third zone reject ramp 106.

Figure 19:
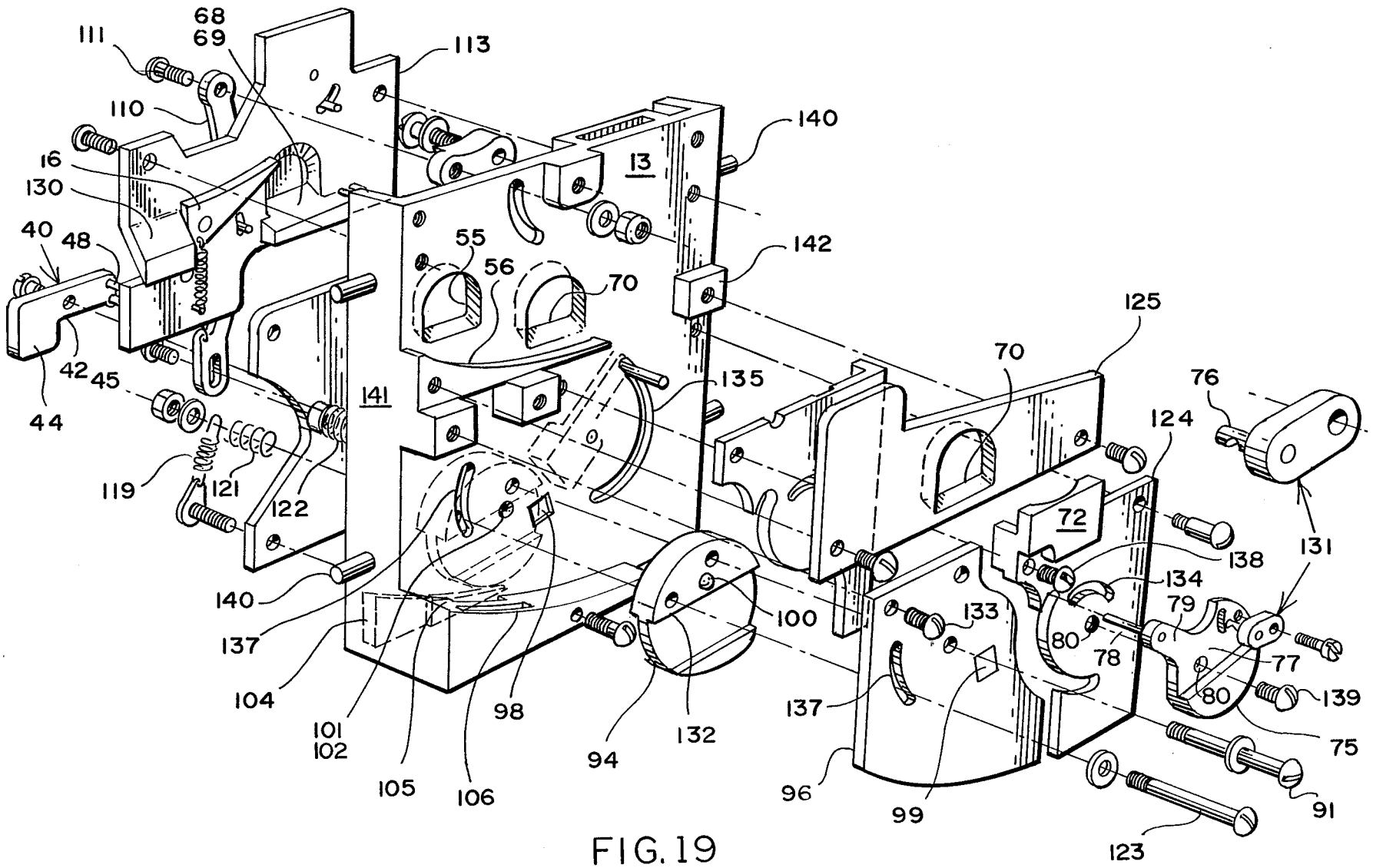
FIG. 19 is an enlarged perspective exploded view showing the main plate in the center, with the third zone to the right, and the first and second zones to the left.

The foregoing parts and their specific relationships are shown in part in FIG. 19 where it will be seen that the main plate 13 is in a central position, and it contains the second zone diverter 55 as well as the third zone diverter 70. To be noted particularly at the lower portion of the exploded elements are the elements of the final size gauge 90 which is pivotally secured to the various frame members. In connection with the following description of parts and FIGS. 19 and 20 the terms five cent, ten cent, and twenty-five cents will be used to specifically identify the involved coins of varying diameters and weights. In FIG. 19 it will be seen that the twenty-five cent release lever 109 appears at the right-hand side.

Figure 20:
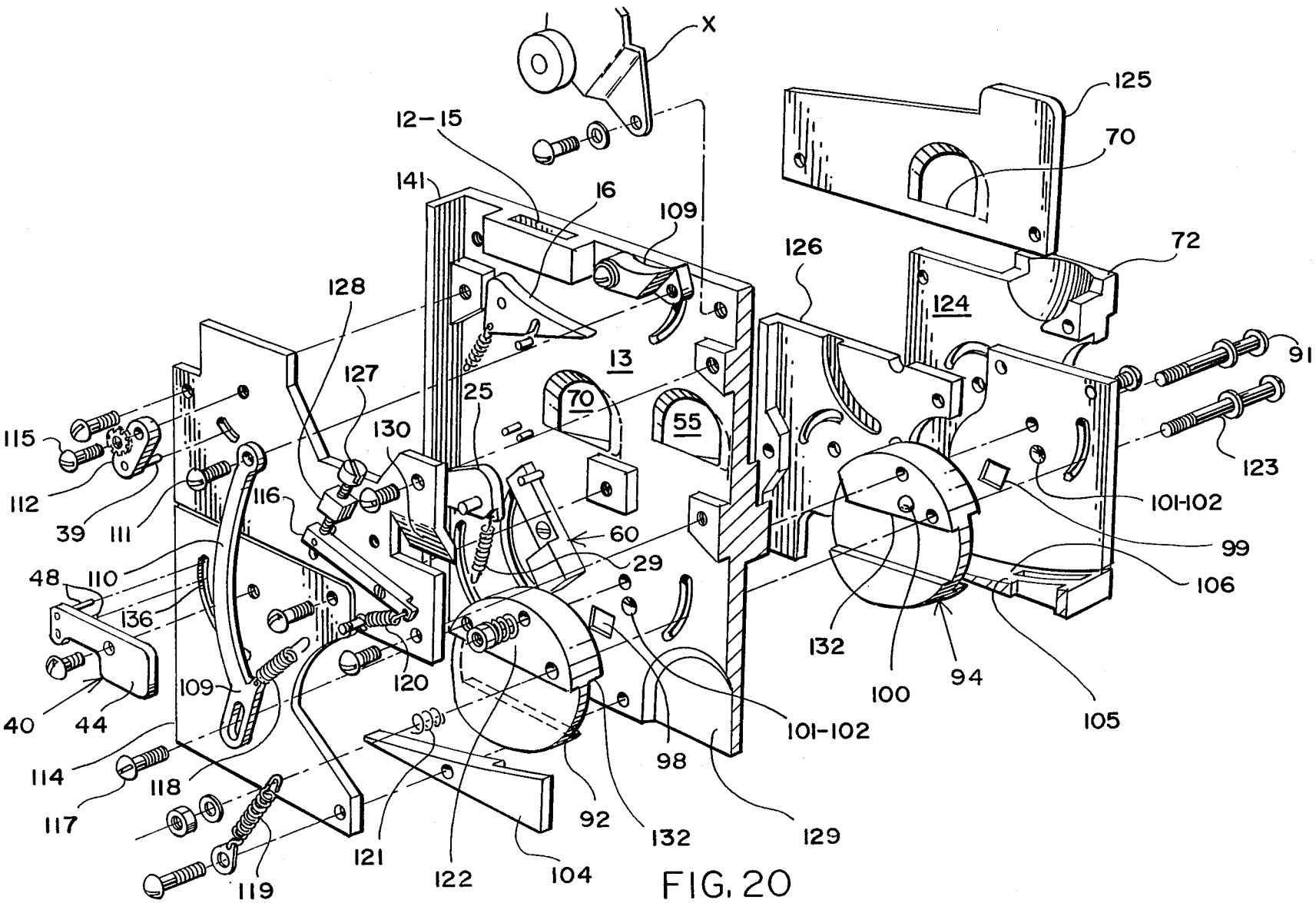
FIG. 20 is an enlarged exploded perspective view taken from the reject actuator side of the coin acceptor showing the first zone, second zone, and third zone from lower left to upper right.

In FIG. 20, the main plate 13 is shown with its respective second zone diverter 55 and third zone diverter 70. Also note particularly the reject actuator arm 110 and its coupled relationship with the final size gauge elements 90.

Referring now to FIGS. 19 and 20, it will be seen that the release pivot lever 109 is activated by the release pivot lever connector rod 110 which, in turn, pivots around connector rod axle 111. Adjustment arm 112 is secured to the first zone mounting plate 113 and secured by set screw 115. An auxiliary retard arm 116 is secured by a mount screw 139 which, in turn, coacts with retard spring 120. Shown in FIG. 20 is the nickel assembly mounting plate 114. Also shown are return springs 118, 119 which coact respectively with the release connector rod 110 and the drive shaft 123 of the final size gauge 90. The connector rod pivot screw 117 secures the release connector rod 110 to the final guage assembly 90. Also provided are two compression springs 121, 122 which are part of the final size gauge 90. Drive shaft 123 is coupled to the first zone track plate 92 and the second and third zone track 94. The quarter or twenty-five cent assembly plate 124 coacts with shift block 72 and is adjacent the ten cent or dime retaining plate 125. A cavity separator 126 serves to process both the ten cent and twenty-five cent pieces. The tension set screw 127 coacts with the retard spring 120 as shown and screw mounting block 128 coacts with the offset five cent slot 129. Deflector block 130 assists in processing the ten cent piece or dime in cooperation with the first zone mounting plate 113. The twenty-five cent release assembly 131 shown in FIG. 19 coacts with the differentiator thickness weight diameter 75 essentially as described above. The bevel 132 is in the first zone track plate 92 as well as coacts with the second and third zone track 94 as essentially shown in FIG. 20. The expansion plate mounting screws 133 are positioned as shown in FIG. 19. Also shown is the curved slot for the quarters 134 and the curved slot 135 for the ten cent items as well as the curved slot for the five cent pieces 136 are all set forth in FIG. 19. Two shaft slots 137 are provided as shown in FIG. 19. The quarter assembly plate is mounted by mounting screws 138 as shown in FIG. 19. Shown as screw 139 is the pivotal axis for the differentiator thickness weight diameter means 75, differentiator lightweight and diameter means 60, undersize heavy coin differentiator 40, and auxiliary retard arm 116 which, in turn, coacts with spring loaded retarding pin 31. The four chassis mount screws 140 shown at the left-hand portion of FIG. 19 are the side plate mounting screws. Cabinet walls 141 are two in number and shown in FIG. 19, along with spacing blocks 142 which divide the separate zones and proportion the same. Other details, not described with precision, are set forth fully and completely in FIGS. 19 and 20.

The method of the present invention is directed primarily to defining coins of three separate sizes, denominations, thicknesses, and weights, into three separate zones. In each of the respective zones, varying tests for diameter and weight are performed on the coins, with all coins entering into a first zone which has a first differentiation as to weight and diverts the lighter coin into the second zone. The first stage of the first zone is proportioned to pass all coins thereby avoiding jamming, build-ups, and shingling. For example, where a quarter is trapped and reversed to pass to the third zone, a slightly oversized coin such as the Susan B. Anthony dollar will also reverse and pass into the third zone but will be rejected at the threshold of the final size gauge. The heaviest coin and the largest diameter diverts into the third zone as it passes through the second zone but is examined for weight. Common to all three of the zones, however, is a trap chute assembly or final size gauge into which all three of the coins are simultaneously directed, but into separate chutes. The chutes are proportioned to size and detect mutilations of size in any coin which passes all of the tests for weight and size and otherwise is determined as good legal tender. To release a trapped coin, the operator will press the reject button and the entire trap assembly is rotated and separated to thereafter "dump" the coins into a reject slot.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification, and appended claims.

What is claimed is:

1. A coin acceptor comprising, in combination, a receiving chute for coins of three different denominations, a means dividing the acceptor into a first zone, a second zone, and a third zone, weight gauging means pivotally mounted interiorly of the first zone to differentiate the heavier coins and pass the same, a second zone diverter adjacent the weight gauging means which will accept a lightweight coin which does not actuate the weight gauging means and divert the light weight coin into the second zone for further processing, a diameter gauge assembly at a remote portion of the first zone beneath the receiving chute which will reverse the passage of a large diameter coin to a third zone diverter, but otherwise permit the passage of a small diameter coin into a further gauge, pivotally mounted differentiators in the first zone, each of which is proportioned to rotatably direct an accepted coin toward a final size gauge, the final size gauge having expandable coin chutes for proper size coins in the first zone, second zone, and third zone, and means for rotating the final size gauge and expanding the same to thereby divert unacceptable coins which have been mutilated or out of size into a reject area.

2. In the coin acceptor of claim 1 above, magnetic means provided interiorly of the final size gauge to entrap any parts or coins through the ferrous content of which is at an unacceptable level.

3. In the coin acceptor of claim 1, an angled diverter wall immediately after the coin receiving chute for receiving all three denominations of coins and diverting the same in a direction towards the weight gauging means.

4. In the coin acceptor of claim 1, yieldable retarding means attached to the weight gauging means which assists in directing the heavier weight coins into the diameter gauge which will accept the small diameter coin, and divert the large diameter coin into the third zone.

5. A method of detecting three separate coins which vary as to diameter, weight, or thickness for acceptance in a coin acceptor having three zones based upon the diameter, thickness, and weight comprising the steps of:

directing all three coins into a first zone, checking the coins in the first zone first for weight and diverting the lightest coin into a second zone, but continuing to process the two larger and heavier coins in the first zone, diameter gauging the larger and heavier two coins in the first zone, and reversing the direction of the largest diameter and heaviest coin into a third zone, and permitting the next smaller and next heaviest coin to remain in the first zone, diameter gauging the coins further in the first, second and third zone by means of a rotatable cradle having pins for receiving the coins, diverting all three coins by the rotatable cradle into expandable and rotatable chute means having separate chutes, gauging the presence of defects in each of the three coins in each separate chute by precisely tapering the separate chutes to the diameter and thickness of each of said three coins so that a coin which is out of size or mutilated will be trapped in the taper of its chute, and providing means for rotating and separating the chutes by the operator to divert an unacceptable coin into a reject zone.

6. In the method of claim 5 above, sensing the coins by magnetic means positioned adjacent the chutes which, even though the coins are otherwise acceptable from a standpoint of diameter, weight, thickness, and lack of mutilation will retard the coins and require reversal and rejecting of such coins.

7. In the method of claim 5 above, directing all three separate coins into a single central receiving means, and deflecting the coins upon entry to the single central receiving means to thereby establish a speed and direction to control each of the three coins for further processing.

8. In a coin acceptor having means for selectively processing coins of increasing size and weight and varying denominations and having multiple processing zones, means in said zones for differentiating the coins, and means in said zones for measuring the thickness of the coins, a final size gauge being fed from said multiple zones for processing the various coins, said size gauge having multiple rotatable and expandable zone tracks, each of said tracks being proportioned to taper both in diameter and in thickness to the precise size of the coin to be accepted even though legal tender coin is presented, and means for reversibly rotating said final size gauge and expanding the tracks so that any coin which becomes entrapped in the various tracks is tilted to a reject discharge orientation, and the coin is thereafter released.

9. In the acceptor of claim 8 above, magnetic means positioned to define a magnetic field in each of said tracks, whereby improper ferrous content even for a coin of perfect dimension will be detected, and the passage of the coin through the track retarded, whereby the coin is reversibly rotated and released for discharge to a reject portion of the unit.

10. A coin acceptor comprising, in combination, an upper receiving chute for three separate coins which vary as to diameter, weight, or thickness, means for dividing the acceptor into a first zone, second zone, and third zone, each of said zones being essentially parallel to each other and terminating at the lower portion of the acceptor, first and second weight gauging means pivotally mounted interiorly of the first zone to differentiate the coins by weight and pass the same, said first weight gauging means being in a first stage and being proportioned to pass all coins whether for further processing in the first, second, or third zone, or for discharge, said second weight gauging means proportioned to pass the lightest coin into the second zone and one of the heavier coins having the larger diameter into the third zone, whereby all coins are passed through the first stage and jamming, pile-ups, and shingling is avoided and the coins which are passed ultimately are accepted or rejected in their respective zones of processing.

11. In the coin acceptor of claim 10 above, said first and second weight gauging means includes, a first pivotally mounted such gauge, and a second pivotally mounted such gauge, respectively, and means for permitting the second pivotally mounted gauge to retract prior to passing coins of larger weight, whereby said coins are permitted to divert from the first zone into the subsequent second or third zones for further processing, and the avoidance of jamming or blockage.

12. In the coin acceptor of claim 10 above, said chute having angled walls to direct each coin onto the first weight gauging means.

13. In the coin acceptor of claim 11, said chute having angled walls to direct all coins toward the pivot of said first pivotally mounted gauge.

* * * * *